US007469492B1

(12) United States Patent
You

(10) Patent No.: US 7,469,492 B1
(45) Date of Patent: Dec. 30, 2008

(54) ELECTRIC STEAM IRON

(76) Inventor: Tuming You, 265 Jia He Road, No. 2102, Xiamen (CN)

( * ) Notice: Subject to any disclaimer, the term of this patent is extended or adjusted under 35 U.S.C. 154(b) by 0 days.

(21) Appl. No.: 11/938,731

(22) Filed: Nov. 12, 2007

(51) Int. Cl.
*D06F 75/14* (2006.01)
*D06F 75/08* (2006.01)

(52) U.S. Cl. ..... 38/77.8; 38/77.83

(58) Field of Classification Search ..... 38/77.1–77.83, 38/88; 219/245; 68/222; 417/510, 234, 417/374
See application file for complete search history.

(56) References Cited

U.S. PATENT DOCUMENTS 4,706,848 A * 11/1987 D'Andrade ..... 222/79
4,857,703 A * 8/1989 Wilkins ..... 392/399
5,010,664 A * 4/1991 Sakano et al. ..... 38/77.7
5,349,767 A * 9/1994 Foo ..... 38/16
5,638,622 A * 6/1997 Hohn ..... 38/77.5
6,540,168 B1 * 4/2003 Archer et al. ..... 242/388.6
7,191,554 B2 * 3/2007 Almanzar et al. ..... 38/77.5
2008/0001000 A1 1/2008 You
2008/0047172 A1 2/2008 You

FOREIGN PATENT DOCUMENTS

JP 408131696 A * 5/1996

OTHER PUBLICATIONS

U.S. Appl. No. 11/651,903, filed Jan. 9, 2007, Tuming You.
U.S. Appl. No. 11/703,044, filed Feb. 5, 2007, Tuming You.

* cited by examiner

*Primary Examiner*—Ismael Izaguirre
(74) *Attorney, Agent, or Firm*—Squire Sanders & Dempsey LLP

(57) ABSTRACT

An electric steam iron includes: a shell, in which other parts are assembled, includes a hand handle for holding device. A soleplate, of which ironing flat is formed on the bottom, is fixed on the lower side of shell. A steam chamber for forming steam, which is positioned above soleplate, has a water inlet and steam nozzles in the ironing flat. A heater is provided on the soleplate. Water tank, which is fixed in the shell, has a water intake and water outlet, and the water outlet connects to water inlet of steam chamber by a pipe. A water pump is fixed in pipeline of pipe. A motor for driving water pump is fixed in the shell.

8 Claims, 7 Drawing Sheets

ELECTRIC STEAM IRON

CROSS-REFERENCE TO RELATED APPLICATION

This application claims priority to Chinese patent application No. 200710009178.2, filed on 29 Jun. 2007, the teachings of which are incorporated herein by reference in their entirety.

FIELD OF THE INVENTION

The present invention relates to an iron, more particularly, to an electric steam iron.

BACKGROUND OF THE INVENTION

Burst steam is main function of electric steam iron, usually we calls it bursting steam function due to steam spraying with certain pressure. The function is performed as follow: a water tank is positioned in the electric steam iron, a steam chamber is set on upper side of the soleplate, and the water tank connects to steam chamber by an aqueduct. A pump is positioned in the pipeline of the aqueduct, and a driving device through manual pressing for operating water pump is set in the water pump. When operating, a heater heats soleplate, and water is pumped from water tank by the water pump to enter heated steam chamber through aqueduct by pressing the button of the water pump driving device, so the formed steam burst out from nozzle.

A shortcoming of the above mentioned electric steam iron is its inconvenience for operation due to the pump driving device by manual pressing, the operator need press the button for spraying steam from soleplate every time, so far, not only this operating is inconvenient, but also steam discontinuously sprayed out, it should affect ironing efficiency.

THE SUMMARY OF THE INVENTION

The present invention provides an electric steam iron for overcoming above mentioned disadvantages such as operating inconveniently and steam sprayed discontinuously.

The present invention provides the following technology:

An electric steam iron that includes: a shell, in which parts are assembled, including a hand handle for holding the device; a soleplate, of which ironing flat is formed on the bottom, being fixed on the lower side of shell; a steam chamber for forming steam, which can be positioned above soleplate, having a water inlet and nozzles in the ironing flat; a heater, which provided on the soleplate; a water tank, which can be fixed in the shell, having a water intake and water outlet, the water outlet connecting to the water inlet of steam chamber by an aqueduct; a water pump, which is fixed in pipeline of aqueduct; and a motor for driving water pump, which can be fixed in the shell.

The water pump of the electric steam iron can be a reciprocating water pump, a cam mechanism for pressing piston-rod to and fro is positioned on the extended end of the piston-rod, and the transmission shaft of the cam mechanism drives by output shaft of the motor through reducer mechanism.

In addition, the position between the circumference of the piston-rod and sidewalls can form a groove, a slide block touching the piston-rod can be positioned in the groove, and the circumference of piston-rod can touch the slide block.

In some embodiments, the heater of the electric steam iron can include an electrical heating element which is buried in the soleplate when casting soleplate, and a thermostat for limiting temperature, which links with the soleplate, connects to the electrical heating element. A temperature adjustable button can be provided on thermostat.

In some embodiments, the steam chamber of the electric steam iron can be in a curvilinear pipe shape, and the water inlet and steam nozzles are separately positioned on the two ends of the chamber.

In some embodiments, the water tank of the electric steam iron can be set in the front top of the shell; the hand handle extended to the end of shell is provided upon the water tank; the water pump is set on the top of water tank, the piston-rod extends vertically and it's end extends uprightly; the water outlet of the water tank connects to the water intake positioned below the water pump; furthermore, a sucker can be included, which links to the inside of the water intake, to extend to the bottom of the water tank.

In some embodiments, the electric steam iron can include a button for controlling the motor start-up and stop and be set on the shell.

Furthermore, in some embodiments, the reducer mechanism can include a worm fixed with the output shaft of the motor, a worm-gear engaged with the worm, a primary gear fixed to the same shaft of the worm-gear, and a secondary gear fixed with transmission shaft of the cam mechanism.

In some embodiments, the rotating shaft of the primary gear and the rotating shaft frame of the secondary gear, which extend along right-hand and left-hand of the iron, can be positioned in the shell; and the output shaft of the motor extends upwards and downwards.

It is known from the description for the structure of the present application, compared with the present technology, advantages of the present invention can include the following:

1) Because of using motor to drive water pump, it is unnecessary to press the piston rod of water pump by hand, and only opening motor for driving the water pump. Thus, it can operate conveniently.

2) The water pump will work continuously if the motor keeps moving, and thus the steam sprays out more continuously and forcefully.

3) The present application can be adopted for use in the existing electric steam iron conveniently, and it is unnecessary to modify too many parts of the present electric steam iron. Therefore, the motor and cam mechanism of invention can be added to the present electric steam iron to allow one to receive the benefit of the present invention with low cost.

DESCRIPTION OF SPECIFIC EMBODIMENTS

The First Embodiment

Figure 1:
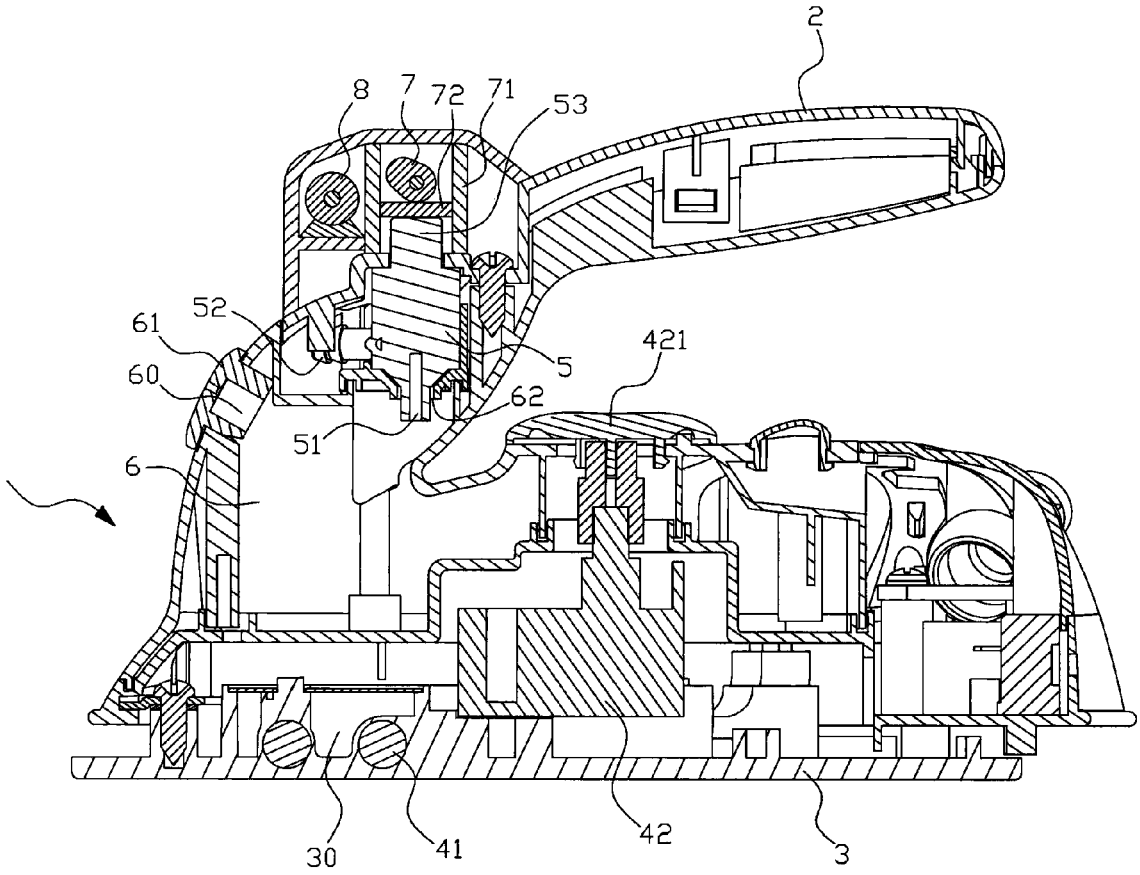
FIG. 1 is the sectional view of the first embodiment of the present application.

Referring to FIG. 1, an electric steam iron of the present invention can include: a shell 1, in which parts are assembled to form an electric steam iron; a hand handle 2 for holdings the device, which is positioned above the front of shell 1 and extend to the end of shell 1; a soleplate 3, of which an ironing flat is formed on the bottom, being fixed on the lower side of shell 1; a steam chamber 30 for forming steam, which is positioned above soleplate 3, having a water inlet 301 and nozzles in the ironing flat. The position of water inlet 301 should refer to FIG. 2, and the position of nozzles can't be shown in FIG. 2 due to angle of view.

Still referring to FIG. 1, a heater for heating soleplate 3 and steam chamber 30, which includes an electrical heating element 41 cast in the soleplate 3, is provided on the soleplate 3. A thermostat 42 for limiting temperature extreme, which links with the soleplate 3, connects to the electrical heating element 41. A temperature adjustable button 421 is provided on thermostat 42. Thermostat 42 is set in the middle of shell 1, and the adjustable button 421 is set in the middle of top shell. The temperature of electrical heating element 41 should be adjusted by the button 421.

Still referring to FIG. 1, a water tank 6 is formed in the front of shell 1, a water intake 60 and a water outlet 62 are positioned in the water tank 6. The water intake 60, which is positioned in the front sidewalls of the joint linked the shell 1 to hand handle 2, has a cover 61. The water outlet 62 is provided in the upside of water tank 6.

Still referring to FIG. 1, a water pump 5, which is a reciprocating water pump, is positioned upon the water outlet 62 of water tank 6; water from the water tank 6 is pumped by a piston-rod moving to and fro; a water intake 51 linked to water outlet 62 of water tank and water outlet 52 in the sidewalls of water pump 5 are provided in the water pump 5. A sucker, which is shown in FIG. 3A, is linked with water intake 51 and extends into water tank 6 until the bottom of water tank 6, so as to make it easy for the water pump to pump water from water tank 6 entirely. The water outlet 52 is linked to water inlet 301 of steam chamber 30 by an aqueduct, which is not shown, and shown in more detail in FIG. 2.

Still referring to FIG. 1, a cam mechanism 7 for pressing the extended end 53 of the piston-rod to and fro is positioned on the extended end 53 of the piston-rod of the water pump 5, the position between the circumference of the extended end of piston-rod and sidewalls 71 form a groove, a slide block 72 touches the extended end 53 of piston-rod and is positioned in the groove, and the circumference of the cam mechanism 7 touches the slide block 72. A motor 8 is set on the front of the cam mechanism 7; the output shaft of the motor 8 transmits the transmission shaft of the cam mechanism 7 by a reducer mechanism, which is not shown. Moreover, in some embodiments, one can adopt a reducer motor instead of motor 8 without using a reducer mechanism. When motor 8 works, it would drive the cam of cam mechanism 7 to rotate and cause the slide block 72 to press the extend end 53 of the reciprocating piston-rod to move to and fro so as to cause water pump 5 to operate.

Figure 1A:
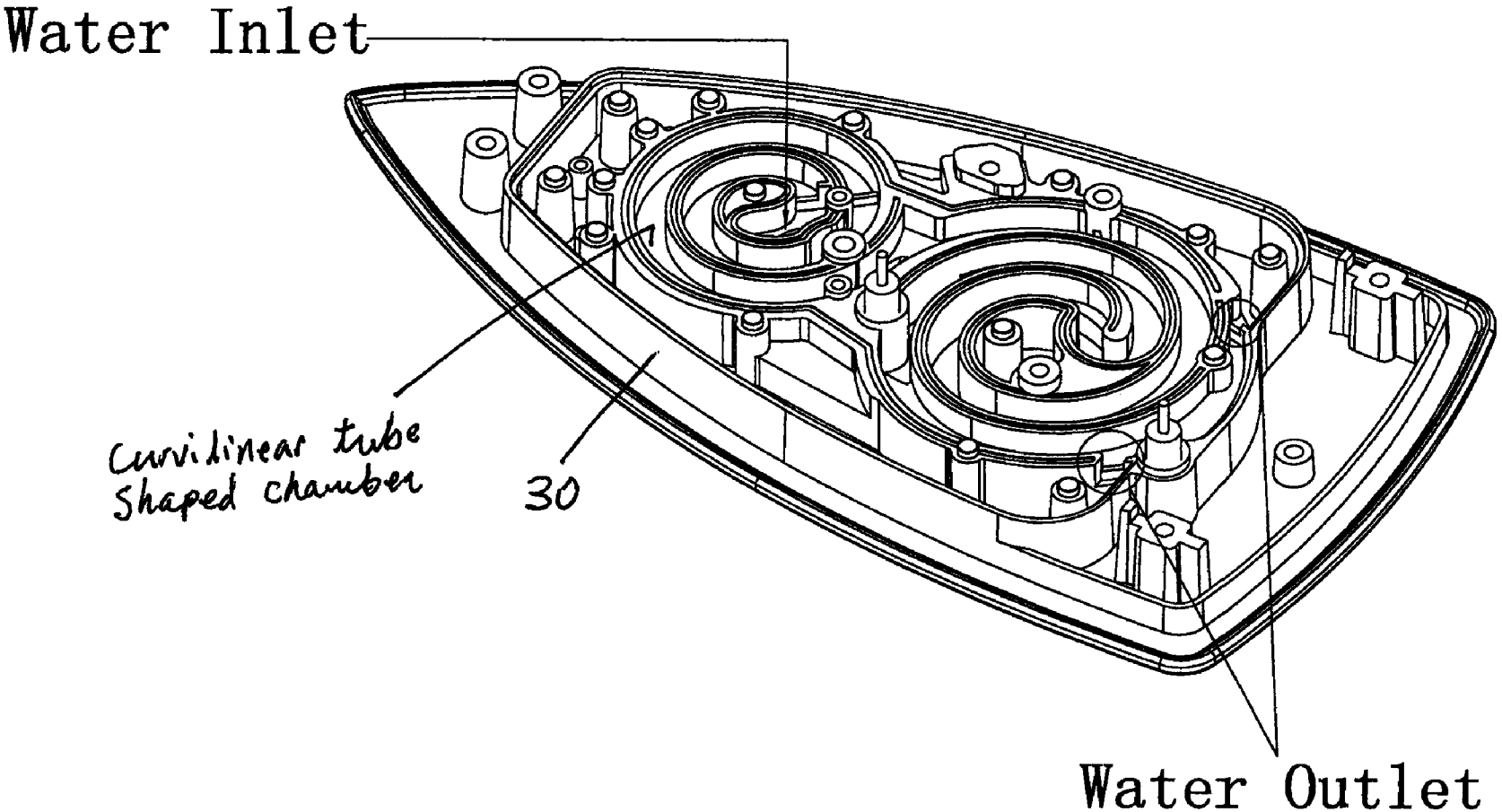
FIG. 1A shows the interior view of a curvilinear tube shaped chamber formed in a steam chamber for forming steam of the present invention.

Still referring to FIG. 1, a curvilinear tube shaped chamber is formed in the steam chamber for forming steam 30, and the water inlet 301 and steam nozzle of ironing flat in soleplate 3 are separately positioned on the ends of the chamber. The inside construction of steam chamber 30 is a present technology and is not shown in the drawing. The interior view of a curvilinear tube shaped chamber formed in the steam chamber for forming steam 30 is shown in FIG. 1A.

In addition, in the electric steam iron described herein, a button for control motor 8 start-up and stop is set in the shell 1. A control circuit board for electrical heating element 41, and thermostat 42 and motor 8 are positioned in the shell 1. These are of present technology and require no further explanation.

The steam spraying process of the above-described electric steam iron can be summarized as follows: the water pump 5 is driven continuously by motor 8 to make water from water tank 6 spraying into the steam chamber 30 through aqueduct; the electrical heating element heats soleplate 3 to make water spraying into steam chamber 30 and vaporize to form a steam, which is sprayed out from the bottom of soleplate 3. Water pump 5 adopts a reciprocating water pump, the output of the motor 8 can be reduced by a reducer mechanism and translated into reciprocating moving by cam mechanism 7 for driving the piston-rod of reciprocating water pump.

The Second Embodiment

Figure 3:
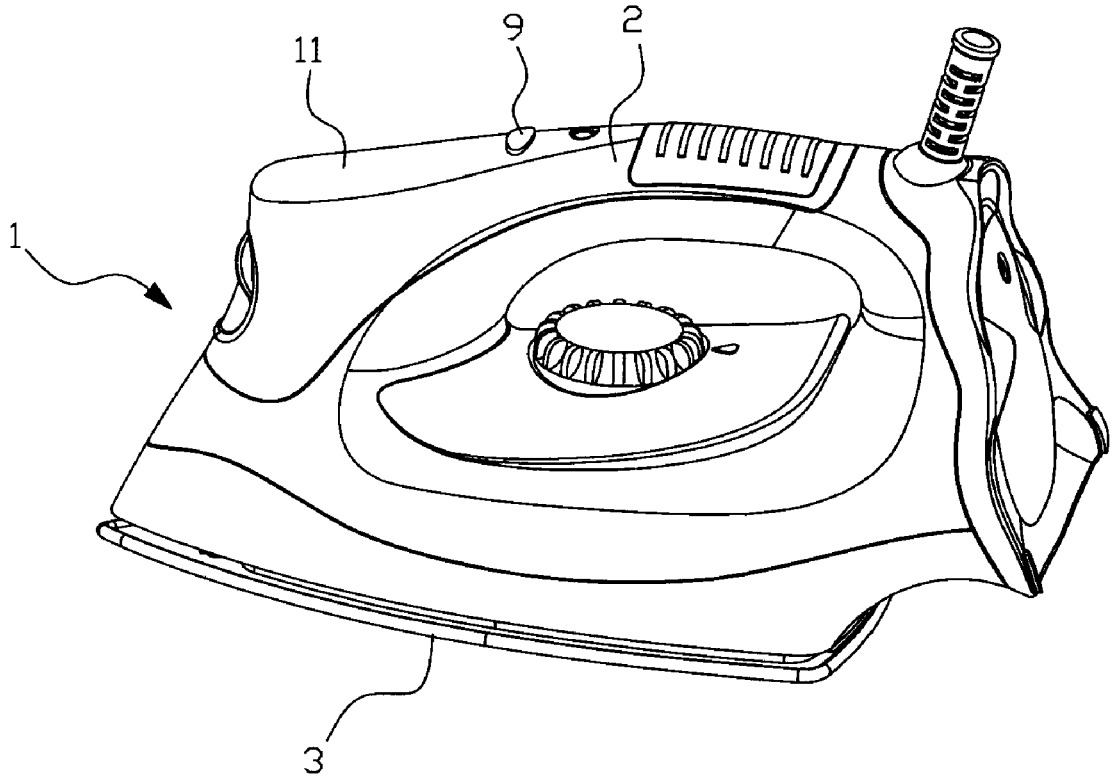
FIG. 3 is the outer structural view of the second embodiment of the present application.

Referring to FIG. 3 and FIG. 3A, a electric steam iron includes: a shell 1, which encloses parts that are assembled to form a electric steam iron; a hand handle 2 for holdings the device, two ends of hand handle 2 link to the front upper side of shell 1 and the rear upper side of shell 1 separately and respectively. A soleplate 3, of which an ironing flat is formed on the bottom, is fixed on the lower side of shell 1.

Figure 2:
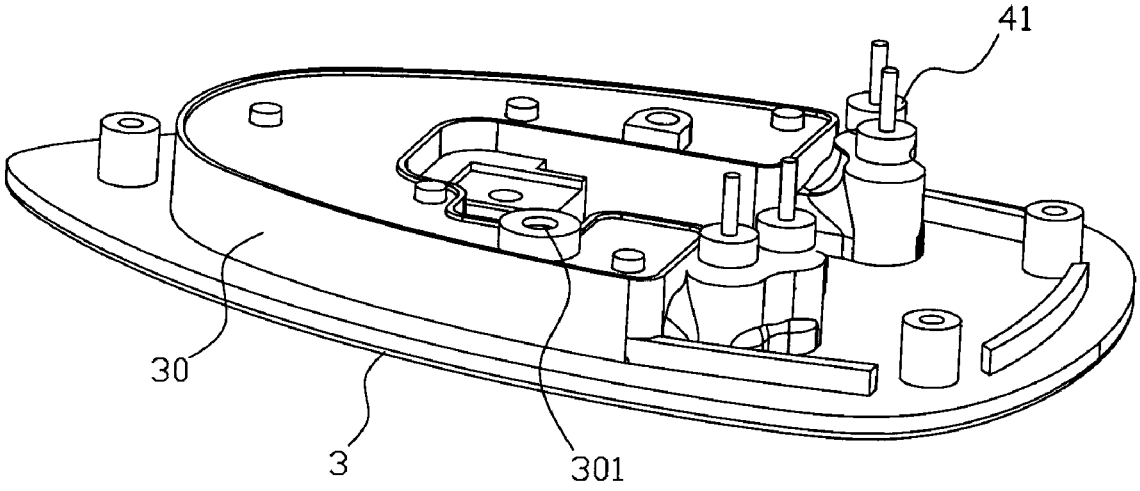
FIG. 2 is the structural view for soleplate of the first embodiment of the present application.
Figure 3A:
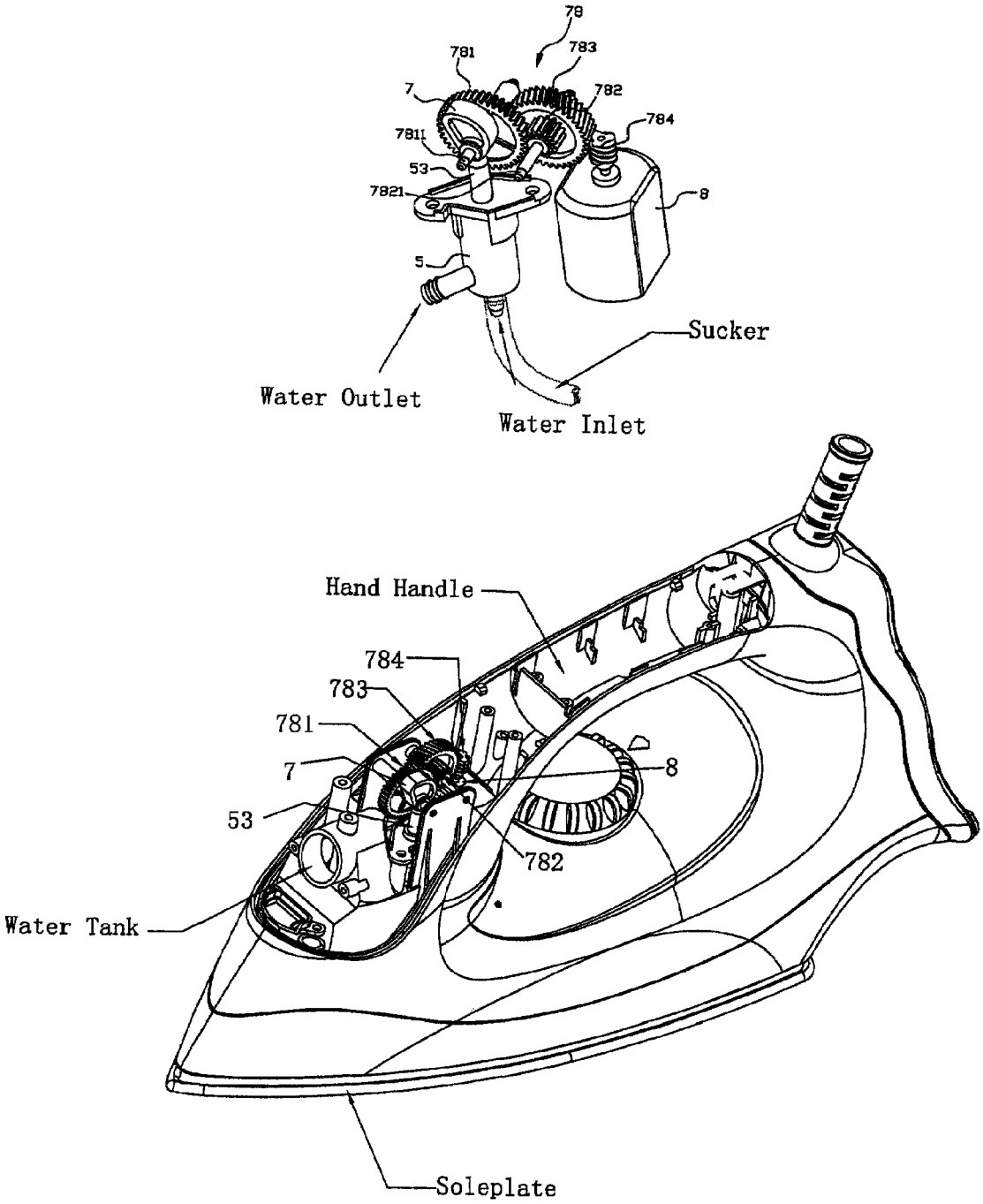
FIG. 3A is the structural view of another embodiment of the present invention.
Figure 4:
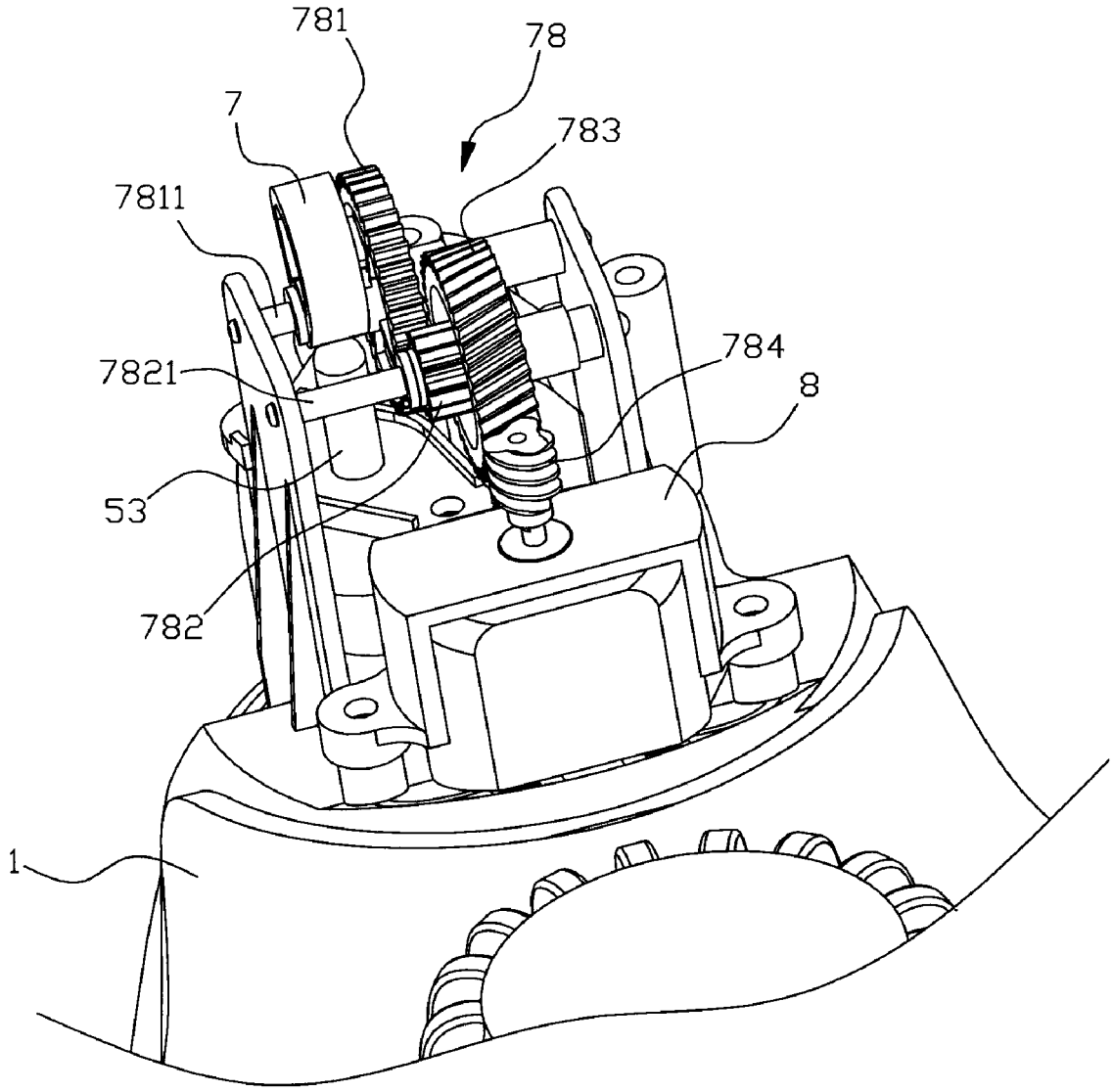
FIG. 4 is the connection view among cam mechanism, motor and reducer mechanism of the second embodiment of the present application.

Referring to FIG. 1 and FIG. 2, the inside construction of the electric steam iron is similar to the first embodiment and can be explained by referring to the description of the first embodiment.

The differences of the second embodiment from the first embodiment include the following:

Referring to FIG. 3, FIG. 3A, FIG. 4 and FIG. 5, the cam mechanism 7, motor 8 and reducer mechanism 78 between motor 8 and cam mechanism 7 are fixed in the protruding part 11 positioned on the front upper side of shell 1, the reducer mechanism 78 comprises a worm 784 fixed with the output shaft of the motor 8, a worm gear 783 engaged with worm 784, a primary gear 782 fixed to the same shaft of the worm-gear 783, and a secondary gear 781 which is engaged with the primary gear 782 and is fixed with the shaft of said cam mechanism 7. The rotating shaft 7821 of the primary gear 782 and the rotating shaft 7811 of the secondary gear 781, which extend along both the right-hand and left-hand of the iron, are hanged in the protruding part 11 positioned on the front upside of shell 1; the output shaft of the motor 8 extends upwards and downwards. The reducer mechanism 78 can cause motion with a reduced speed.

Figure 5:
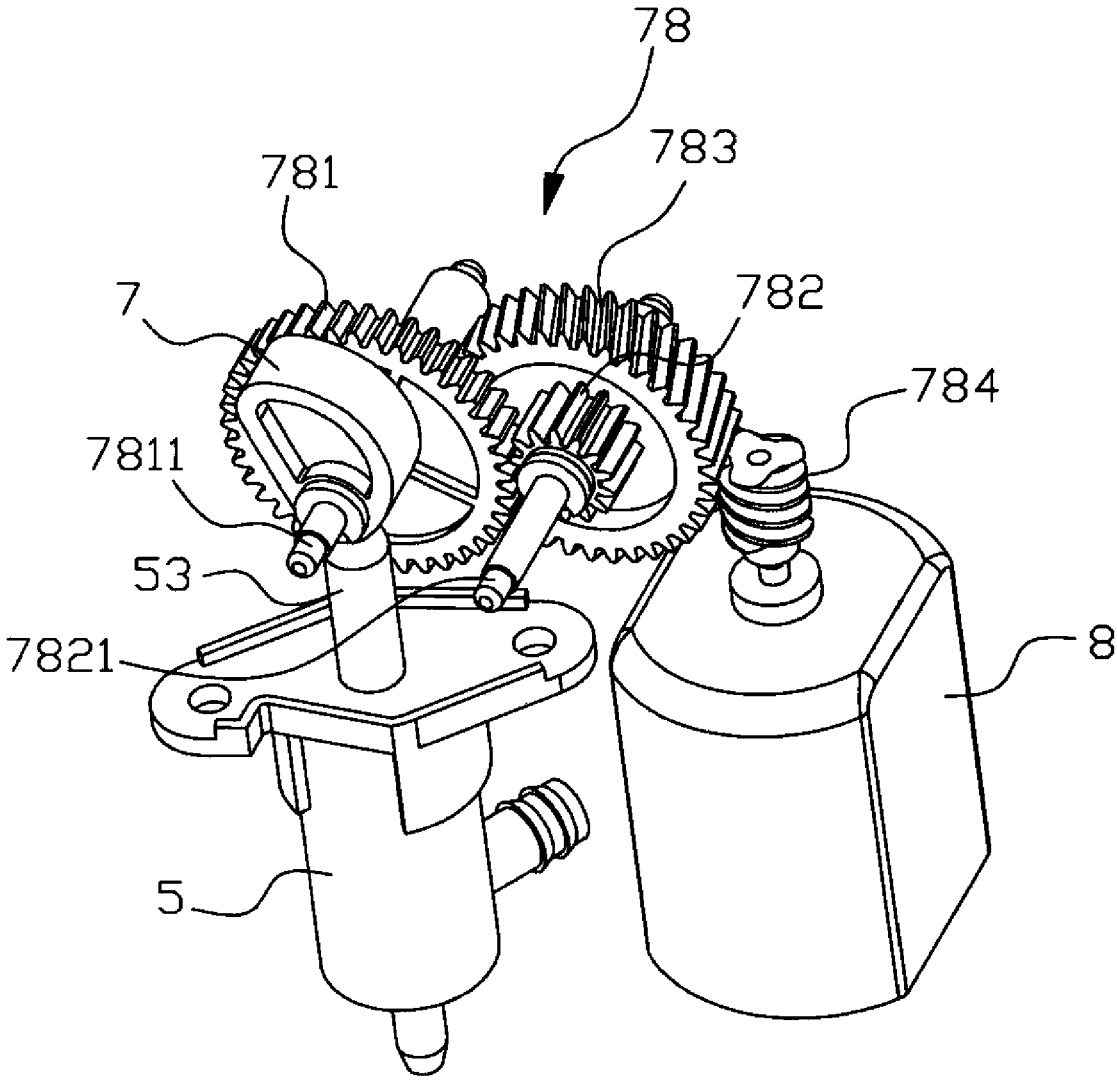
FIG. 5 is the another connection view among cam mechanism, motor and reducer mechanism of the second embodiment of the present application from other angle.

Referring to FIG. 5, the extended end 53 of the piston-rod of water pump 5 is pushed by the cam mechanism 7 to move to and fro, and water in the water tank is pumped into steam chamber, which is similar to the first embodiment, described above.

Referring to FIG. 3, a control button 9 is set in hand handle 2 for controlling the start-up and stop of motor 8.

The above embodiments are offered to illustration of the present invention and shall not be construed to limit the scope of the present application. Equivalent changes and modifications based on the content of the present application all fall within the scope of the present invention.

I claim:

1. An electric steam iron, comprising:

a shell, in which parts are assembled, including a hand handle for holding the device;

a soleplate, of which ironing flat is formed on the bottom, being fixed on the lower side of shell;

a steam chamber for forming steam, which is positioned above soleplate, having a water inlet and nozzles on the ironing flat;

a heater provided on the soleplate;

a water tank, which is fixed in the shell, having a water intake and a water outlet, wherein the water outlet connects to water inlet of steam chamber by a pipe;

a water pump, which is fixed in pipeline of the pipe; and a motor for driving the water pump which is fixed in the shell, wherein the water pump is a reciprocating water pump, wherein a cam mechanism for pressing a piston-rod to and fro is positioned on the extended end of the piston-rod, and wherein the transmission shaft of the cam mechanism is linked to an output shaft of the motor by a reducer mechanism.

2. The electric steam iron of claim 1, further comprising a thermostat connected to the heater by a power cord, wherein the heater includes an electrical heating element buried in the soleplate;

wherein the thermostat is fixed on the soleplate to control the soleplate temperature; and wherein the thermostat comprises a temperature adjustable knob.

3. The electric steam iron of claim 1, wherein the steam chamber is in a curvilinear pipe shape; and wherein the water inlet and steam nozzles are separately positioned on the two ends of steam chamber.

4. The electric steam iron of claim 1, wherein the water tank is set in the front upper side of the shell;

wherein the hand handle is extended to the end of shell and is provided on the upper side of water tank;

wherein the water pump is set on the top of water tank;

wherein the piston-rod extends vertically, the end of which extends uprightly; and wherein the water outlet of the water tank connects to the water intake which is positioned on lower side of the water pump; furthermore, a sucker, which links to the inside of the water intake, extends to the bottom of water tank.

5. The electric steam iron of claim 1, further comprising a button set on the shell for controlling the motor start-up and stop.

6. An electric steam iron, comprising:

a shell, in which parts are assembled, including a hand handle for holding the device;

a soleplate, of which ironing flat is formed on the bottom, being fixed on the lower side of shell;

a steam chamber for forming steam, which is positioned above soleplate, having a water inlet and nozzles on the ironing flat;

a heater provided on the soleplate;

a water tank, which is fixed in the shell, having a water intake and a water outlet, wherein the water outlet connects to water inlet of steam chamber by a pipe;

a water pump, which is fixed in pipeline of the pipe; and a motor for driving the water pump which is fixed in the shell, wherein the water pump is a reciprocating water pump, wherein a cam mechanism for pressing a piston-rod to and fro is positioned on the extended end of the piston-rod, wherein the transmission shaft of the cam mechanism is linked to an output shaft of the motor by a reducer mechanism, wherein the position between the circumference of the piston-rod and sidewalls form a groove, and wherein a slide block touching the piston-rod is positioned in the groove, and the circumference of the piston-rod touching the slide block.

7. An electric steam iron, comprising:

a shell, in which parts are assembled, including a hand handle for holding the device;

a soleplate, of which ironing flat is formed on the bottom, being fixed on the lower side of shell;

a steam chamber for forming steam, which is positioned above soleplate, having a water inlet and nozzles on the ironing flat;

a heater provided on the soleplate;

a water tank, which is fixed in the shell, having a water intake and a water outlet, wherein the water outlet connects to water inlet of steam chamber by a pipe;

a water pump, which is fixed in pipeline of the pipe; and a motor for driving the water pump which is fixed in the shell, wherein the water pump is a reciprocating water pump, wherein a cam mechanism for pressing a piston-rod to and fro is positioned on the extended end of the piston-rod, wherein the transmission shaft of the cam mechanism is linked to an output shaft of the motor by a reducer mechanism, wherein the reducer mechanism includes a worm fixed on the output shaft of the motor, a worm-gear engaged with the worm, a primary gear fixed on a same shaft of the worm-gear and a secondary gear fixed with a transmission shaft of the cam mechanism engaged with the primary gear.

8. The electric steam iron of claim 7, wherein the rotating shaft of the primary gear and the rotating shaft frame of secondary gear, which extend along the right-hand and left-hand of the iron, are positioned on the shell; and the output shaft of the motor extends upwards and downwards.

* * * * *